US005540801A

United States Patent [19]

Grant et al.

[11] Patent Number: 5,540,801

[45] Date of Patent: Jul. 30, 1996

[54] APPARATUS FOR FORMING CORE LAYERS FOR PLYWOOD

[75] Inventors: Garnet E. Grant, Port Moody, Canada; Darryl L. Rapp, Sugar Hill; Mark G. Reifenberger, Norcross, both of Ga.

[73] Assignee: Nordson Corporation, Westlake, Ohio

[21] Appl. No.: 242,255

[22] Filed: May 13, 1994

Related U.S. Application Data

[63] Continuation-in-part of Ser. No. 843,724, Feb. 28, 1992, abandoned.

[51] Int. Cl.[6] ..... B05B 1/14

[52] U.S. Cl. ..... 156/357; 156/559; 156/578; 118/221; 118/302; 118/685

[58] Field of Search ..... 156/356, 357, 156/558, 559, 578; 118/221, 302, 410, 411, 412, 429, 684, 685

[56] References Cited

U.S. PATENT DOCUMENTS

| | | | |
|---|---|---|---|
| 3,900,654 | 8/1975 | Stinger | 428/214 |
| 4,044,182 | 8/1977 | Aizawa | 428/44 |
| 4,049,466 | 11/1977 | Scholl et al. | 156/78 |
| 4,104,983 | 8/1978 | Carstedt | 118/2 |
| 4,453,159 | 6/1984 | Huff et al. | 340/590 |
| 4,922,083 | 5/1990 | Springs et al. | 219/549 |
| 5,145,691 | 9/1992 | Kawakami et al. | 425/110 |

OTHER PUBLICATIONS

Known work performed by others prior to the making of the invention disclosed in the above identified application.

*Primary Examiner*—David A. Simmons
*Assistant Examiner*—Paul M. Rivard
*Attorney, Agent, or Firm*—Tarolli, Sundheim, Covell, Tummino & Szabo

[57] ABSTRACT

An apparatus (12) for use in forming core layers for plywood from a plurality of veneer sections includes a manifold (48) which extends transversely to a work flow path and across which the veneer sections are sequentially moved. An adhesive passage (46) in the manifold (48) is connected in fluid communication with a plurality of modular dispenser guns (44). Each of the modular dispenser guns (44) is connected in fluid communication with either an adhesive dispenser head or a string dispenser head (34). At the adhesive dispenser heads (32), adhesive is engaged by the leading end portion of a veneer section and pressed against the trailing end portion of a next preceding veneer section. At the string dispenser heads (34), string (42) coated with adhesive is applied to downwardly facing major side surfaces of the veneer sections. A plurality of heat conductors (200, 202, and 240) are provided to conduct heat from heaters (96 and 98) in the manifold (48) to the adhesive dispenser heads (32) and the string dispenser heads (34). The heat conductors (200, 202 and 240) have a greater thermal conductivity than the manifold (48). Thus, the heat conductors (200, 202 and 240) may, for example, be formed of copper and the manifold (48) of aluminum.

24 Claims, 12 Drawing Sheets

APPARATUS FOR FORMING CORE LAYERS FOR PLYWOOD

RELATED APPLICATION

This application is a continuation-in-part of U.S. patent application Ser. No. 07/843,724 filed Feb. 28, 1992, now abandoned, by Garnet E. Grant and entitled "Apparatus for Forming Core Layers for Plywood". The benefit of the earlier filing date of the aforesaid application Ser. No. 07/843,724 for all subject matter common this application is hereby claimed.

BACKGROUND OF THE INVENTION

The present invention relates to a new and improved apparatus for use in forming core layers for plywood from a plurality of veneer sections.

Plywood commonly includes core layers formed by veneer sections. The core layers are formed of relatively low quality wood and are sandwiched between panels of relatively high quality wood. Interconnecting the veneer sections with string is disclosed in U.S. Pat. No. 4,044,182.

An apparatus has previously been used to interconnect veneer sections by applying glue spots to edges of the veneer sections. String covered with adhesive was applied to the veneer sections by the apparatus to interconnect and reinforce the veneer sections. This known apparatus included a relatively complicated mechanical linkage arrangement to control the application of adhesive.

SUMMARY OF THE INVENTION

The present invention provides a new and improved apparatus for use in forming core layers for plywood from a plurality of veneer sections. The apparatus includes a manifold across which the veneer sections are sequentially moved. An adhesive passage extends along the manifold.

A plurality of adhesive dispenser heads and string dispenser heads are disposed along the manifold. Each of the adhesive dispenser heads includes an outlet from which adhesive is dispensed for engagement by end portions of the veneer sections. Each of the string dispenser heads includes a passage from which a string coated with adhesive is dispensed to interconnect and reinforce the veneer sections.

A plurality of heat conductors are provided to conduct heat from heaters in the manifold to the adhesive dispenser heads and the string dispenser heads. The heat conductors have a greater thermal conductivity than the manifold. Thus, the heat conductors may, for example, be formed of copper and the manifold of aluminum.

BRIEF DESCRIPTION OF THE DRAWINGS

The foregoing and other features of the invention will become more apparent upon a consideration of the following description taken in connection with the accompanying drawings wherein.

DESCRIPTION OF A SPECIFIC PREFERRED EMBODIMENT OF THE INVENTION

General Description

Figure 1:
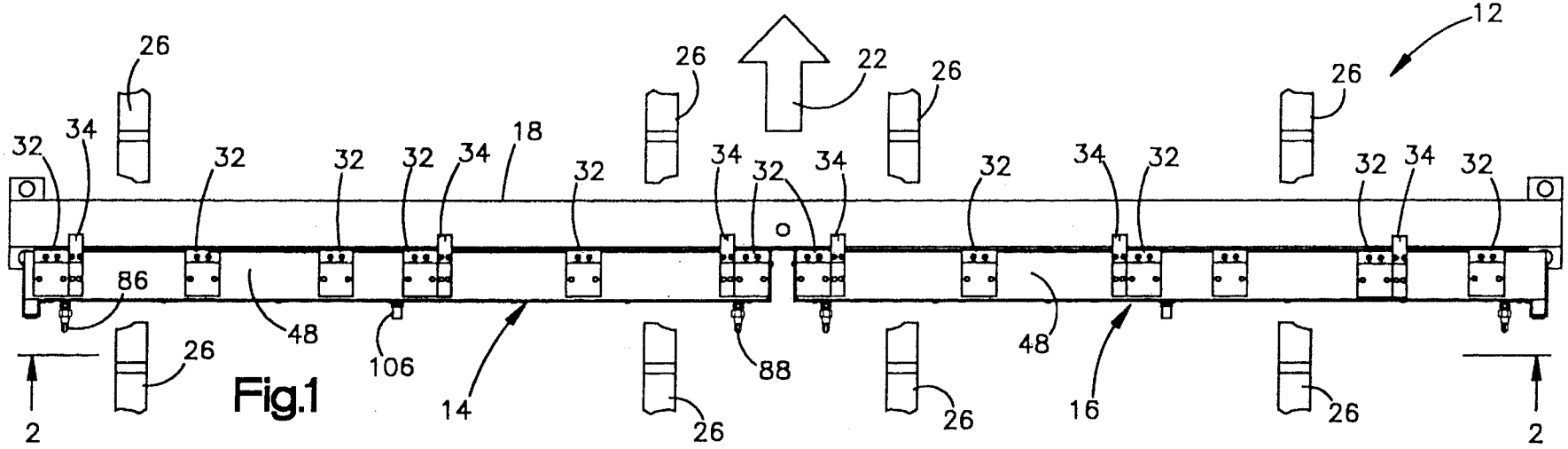
FIG. 1 is a top plan view of an apparatus to form core layers for plywood from a plurality of veneer sections.

An apparatus 12 (FIGS. 1 and 2) for use in forming core layers for plywood from a plurality of veneer sections includes a pair of applicator assemblies 14 and 16 which are connected with a base 18. The apparatus 12 extends across a work flow path, indicated schematically by an arrow 22 in FIG. 1, along which veneer sections are sequentially moved. Each veneer section is intermittently moved along the work flow path 22, in a known manner, by a plurality of conveyor chains which have been indicated schematically at 26 in FIGS. 1 and 2.

A veneer section 24 (FIGS. 2 and 3) is moved to and stopped at a position in which a trailing end portion of the veneer section is supported on a plurality of adhesive dispenser heads 32 and a plurality of string dispenser heads 34. As the leading end portion 38 (FIG. 4) of a next succeeding veneer section 40 approaches the trailing end portion 28 of the stationary veneer section 24, small bodies or dots of hot thermoplastic adhesive are dispensed by the adhesive dispenser heads 32. The leading end portion 38 of the approaching veneer section 40 presses the bodies of thermoplastic adhesive against the trailing end portion 28 of the immediately preceding veneer section 24.

As the small bodies or dots of adhesive are compressed between the trailing end portion 28 of the veneer section 24 and the leading end portion 38 of the veneer section 40, force is transmitted from the trailing veneer section 40 to the leading veneer section 24 to move both veneer sections forwardly. As this occurs, the adhesive sets and interconnects the veneer sections.

As the veneer sections 24 and 40 move forwardly together, string 42 (FIGS. 8 and 9) coated with hot thermoplastic adhesive, is dispensed from the string dispenser heads 34. The coating of adhesive on the string 42 causes the string to adhere to the downwardly facing major sides of the veneer sections 24 and 40. The string 42 extends across the joint between the veneer sections 24 and 40 to further interconnect the veneer sections. The string 42 is secured to the downwardly facing major sides 10 of the veneer sections 24 and 40 by the adhesive, to reinforce the veneer sections.

Figure 3:
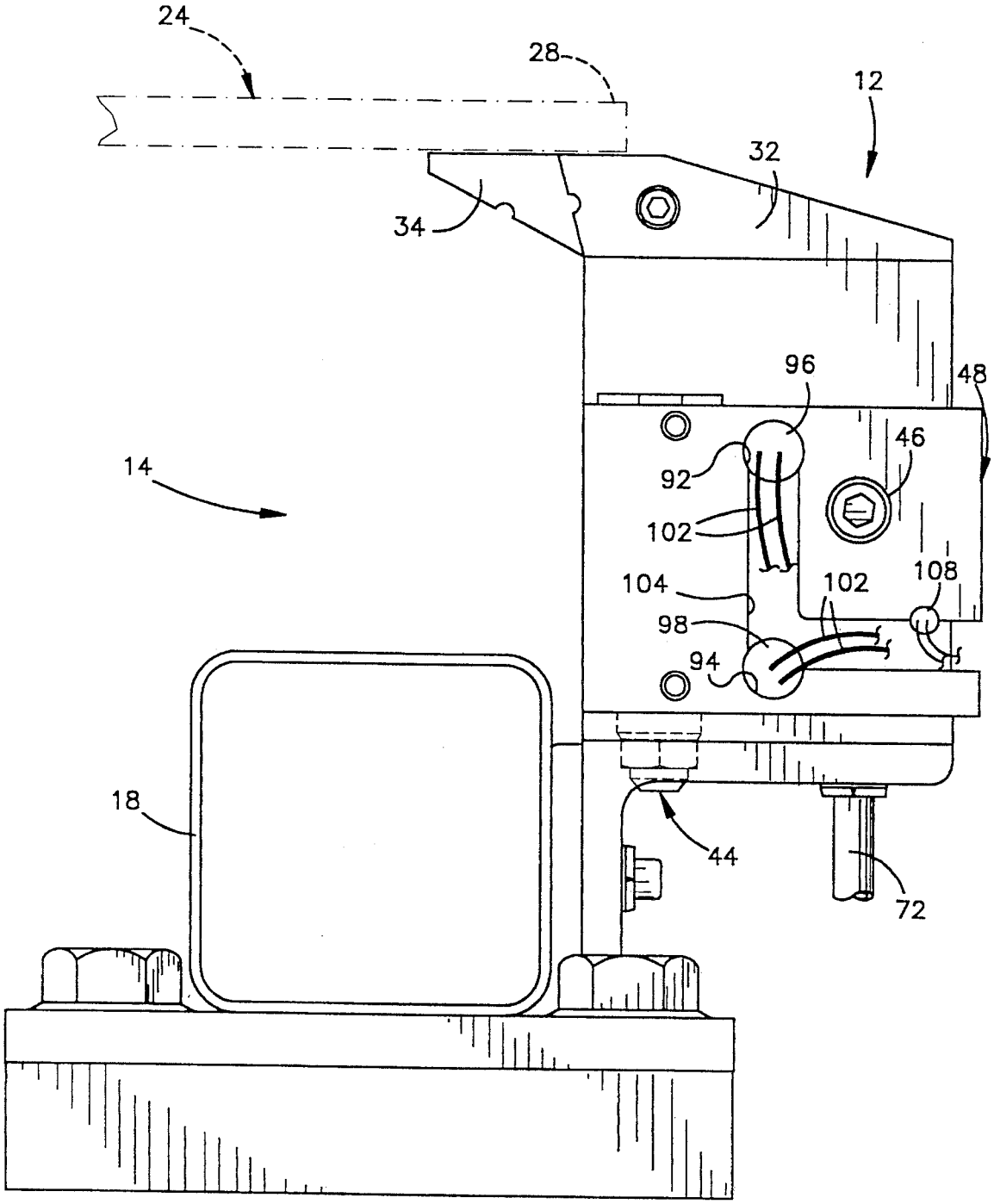
FIG. 3 is a side elevational view, taken on an enlarged scale along the line 3—3 of FIG. 2, illustrating the relationship of a manifold and an adapter block to an adhesive dispenser head and a string dispenser head.

The conveyor chains 26 are operable to move each of the veneer sections in turn onto the adhesive dispenser heads 32 and string dispenser heads 34, in the manner shown for the veneer section 24 in FIG. 3. The conveyor chains 26 are then operable to move the next succeeding veneer section 40 (FIG. 4) into abutting engagement with the preceding veneer section 24 while the preceding veneer section is stationary. The conveyor chains 26 then continue the forward movement of both veneer sections 24 and 40 together along the work flow path 22.

A modular dispenser gun 44 (FIG. 4) is provided at each of the adhesive dispenser heads 32 and at each of the string dispenser heads 34 (FIG. 8) to control the flow of adhesive. Each of the modular dispenser guns 44 is connected in fluid communication with a linear main adhesive passage 46 which extends lengthwise along a manifold 48. The horizontal main adhesive passage 46 is connected with a source of hot thermoplastic adhesive under pressure. The manifold 48 and main adhesive passage 46 extend perpendicular to the work flow path 22 (FIG. 1) of the veneer sections.

Figure 8:
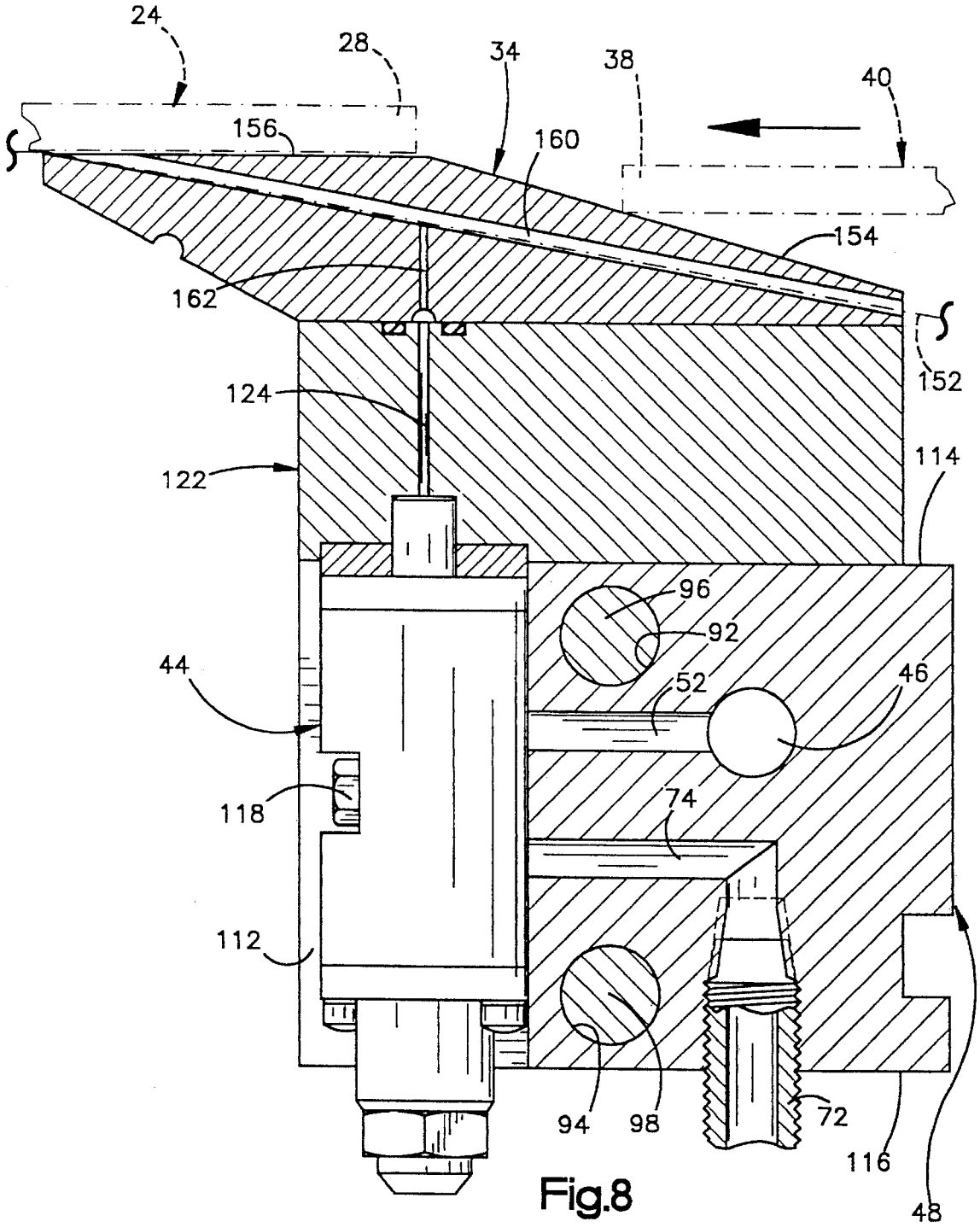
FIG. 8 is a sectional view, taken generally along the line 8—8 of FIG. 2, illustrating the relationship of a modular dispenser gun to the manifold and string dispenser head.

The main adhesive passage 46 is connected in fluid communication with each of the modular dispenser guns 44 for the adhesive dispenser heads 32 (FIG. 4) and the string dispenser heads 34 (FIG. 8). Thus, connector passages 52 (FIG. 4) connect the modular dispenser guns 44 for each of the adhesive dispenser heads 32 with the main adhesive passage 46 in the manifold 48. Similarly, connector passages 54 (FIG. 8) connect the modular dispenser guns 44 for each of the string dispenser heads 34 with the main adhesive passage 46 in the manifold 48.

Each of the modular dispenser guns 44 (FIG. 10) includes a valve member 58 which is movable in a housing 59 between a closed position engaging a valve seat 60 and an open position spaced from the valve seat. When the valve member 58 is in the closed position shown in FIG. 10, the valve member blocks a flow of adhesive from a chamber 62 in the modular dispenser gun 44. Each of the modular dispenser guns 44 includes a heating element (not shown) which maintains the pressurized thermoplastic adhesive in the chamber 62 at a desired temperature.

Figure 10:
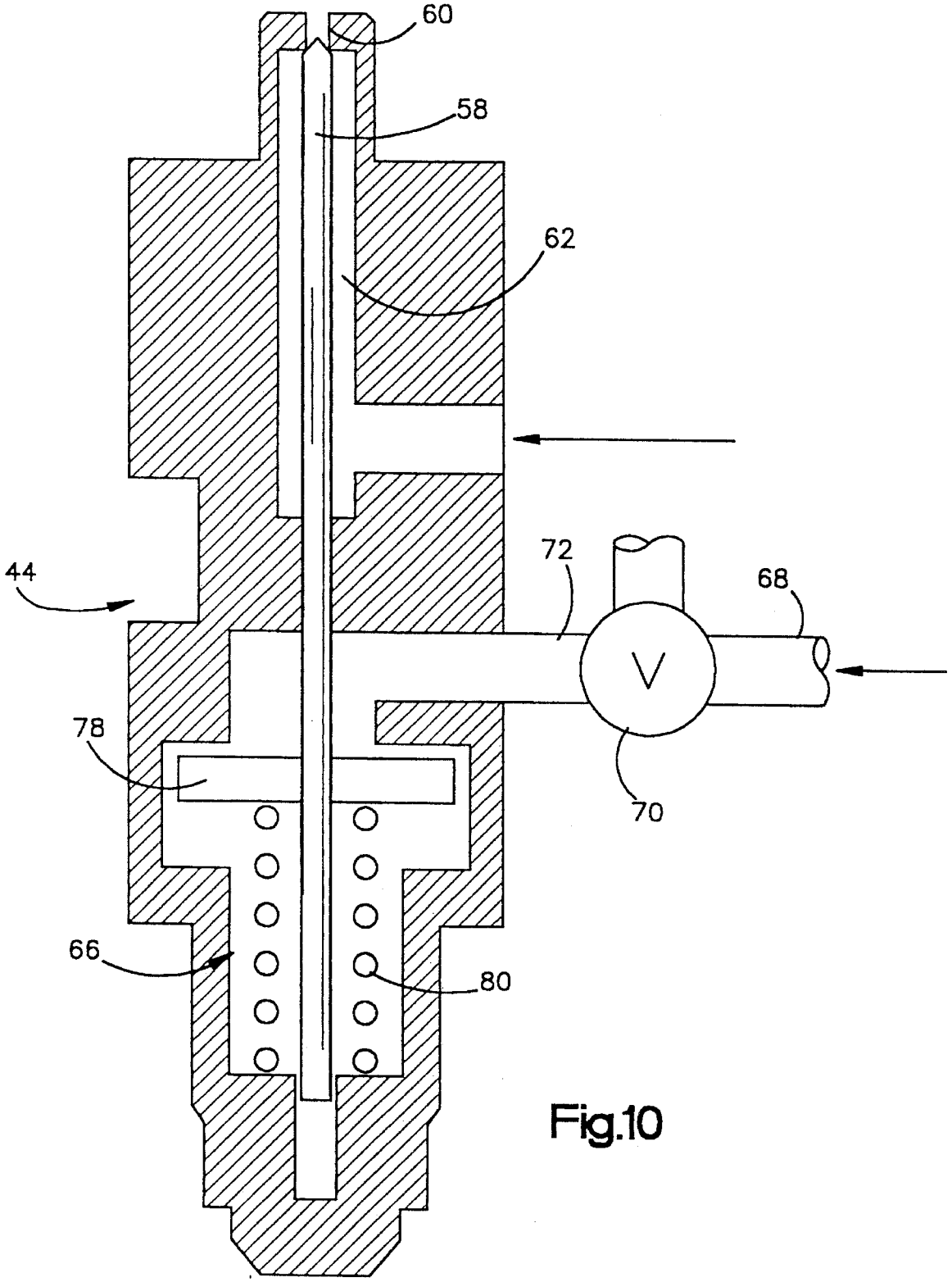
FIG. 10 is a schematic illustration depicting the construction of a modular dispenser gun.

When the valve member 58 is in the open position spaced from the valve seat 60, hot thermoplastic adhesive under pressure flows from the main adhesive passage 46 (FIGS. 4 and 8) through a connector passage 52 or 54 to the chamber 62 in the modular dispenser gun 44 (FIG. 10). The pressurized adhesive flows from the chamber 62 past an open valve member 58. The pressurized hot thermoplastic adhesive then flows upwardly from the modular dispenser gun 44 to either an adhesive dispenser head 32 or a string dispenser head 34.

Each of the modular dispenser guns 44 includes an actuator assembly 66 (FIG. 10) disposed in the housing 59. The actuator assembly 66 is operable to move the valve member 58 vertically between the closed position shown in FIG. 10 and an open position in which the valve member is spaced from the valve seat 60. The actuator assembly 66 is operated under the influence of fluid pressure, that is, under the influence of air pressure. However, if desired, the actuator assembly 66 could utilize an electrical solenoid to move the valve member 58.

Air is conducted from a conduit 68 (FIG. 10) to a plurality of solenoid actuated control valves 70. Each of the control valves 70 is connected in fluid communication with one of the modular dispenser guns 44. When a control valve 70 is in a closed position, the actuator assembly 66 is vented to atmosphere through a vent conduit 82. At this time, air flow from the conduit 68 to the actuator assembly 66 is blocked. Upon operation of the solenoid actuated control valve 70 to an open condition, the conduit 68 is connected in fluid communication with the actuator assembly 66 through conduit 72 and a connector passage 74 (FIGS. 4 and 8) in the manifold 48.

When the control valve 70 is actuated to an open condition, air pressure from the conduit 72 (FIG. 10) enters the actuator 66 and is applied against a piston 78 connected with the valve member 58. The air pressure applied against the piston 78 moves the valve member 58 vertically downwardly from the closed position illustrated in FIG. 10 to an open position against the influence of a biasing spring 80. Once the piston 78 has moved the valve member 58 to the open position, the pressurized adhesive flows from the chamber 62 in the modular dispenser gun 44 to either an adhesive dispenser head 32 (FIG. 4) or a string dispenser head 34 (FIG. 8).

When the valve member 58 (FIG. 10) has been in the open position for a sufficient length of time to enable a desired amount of adhesive to flow to either the adhesive dispenser head 32 (FIG. 4) or the string dispenser head 34 (FIG. 8), the control valve 70 (FIG. 10) is actuated to the closed condition. Closing the control valve 70 vents the actuator assembly 66 to atmosphere through the vent conduit 82. This enables the biasing spring 80 to immediately move the valve member 58 vertically upwardly from the open position to the closed position.

The amount of adhesive which is conducted from the modular dispenser gun 44 to either the adhesive dispenser head 32 (FIG. 4) or the string dispenser head 34 (FIG. 8) is readily controlled by controlling the length of time which the valve 70 (FIG. 10) remains open. The rate at which adhesive is conducted from the modular dispenser gun 44 may be adjusted by varying the distance which the valve member 58 moves away from the valve seat 60 when the valve member is actuated from the closed position of FIG. 10 to the open position. Although it is contemplated that the modular dispenser gun 44 could have many different constructions, in one specific preferred embodiment of the invention, the modular dispenser gun 44 was a Nordson H200 Series Automatic Modular Gun which is available from Nordson Corporation having a place of business at Westlake, Ohio. If desired, the control valves 70 could be included in the modular dispenser guns 44.

Manifold

Each of the applicator assemblies 14 and 16 (FIGS. 1 and 2) includes a one-piece manifold 48 formed from an elongated block of aluminum. A cylindrical main adhesive passage 46 (FIGS. 4 and 8) is formed in the manifold 48 and extends between opposite ends of the manifold. A horizontal longitudinal central axis of the linear main adhesive passage 46 extends parallel to a horizontal longitudinal central axis of the manifold 48. Opposite ends of the main adhesive passage 46 are plugged. Although it is preferred to form the main adhesive passage 46 in the elongated metal block of the manifold 48, the main adhesive passage could be a separate conduit if desired.

Hot thermoplastic adhesive is conducted toward a central portion of the main adhesive passage 46 from locations adjacent to opposite ends of the main adhesive passage. Thus, a pair of adhesive supply conduits 86 and 88 (FIGS. 1 and 2) are connected to opposite ends of the manifold 48. The conduits 86 and 88 are connected in fluid communication with the main adhesive passage 46 adjacent to the plugged ends of the main adhesive passage. The conduits 86 and 88 supply the main adhesive passage 46 with hot thermoplastic adhesive under pressure.

The hot thermoplastic adhesive may flow from opposite ends of the main adhesive passage 46 toward the central portion of the main adhesive passage. This allows the adhesive dispenser heads 32 and string dispenser heads 34 adjacent to opposite ends of the manifold 48 to be rendered inactive without having a body of stagnant adhesive in the main adhesive passage 46. The horizontal connector passages 52 and 54 (FIGS. 4 and 8) are formed in the metal block of the manifold 48. The connector passages 52 and 54 extend perpendicular to the main adhesive passage 46 and connect the main adhesive passage in fluid communication with the modular dispenser guns 44. Providing two independent controlled applicator assemblies 14, 16 as opposed to one manifold of the same length provides for greater system flexibility. For example, in the assembly of veneer sections having a width substantially equal to or less than the length of one of the assemblies it may be desirous to utilize only one of the assemblies at a time.

Cylindrical heater passages 92 and 94 are formed in the metal block of the manifold 48 and extend lengthwise through the manifold between opposite ends of the manifold. The linear heater passages 92 and 94 have horizontal longitudinal central axes which extend parallel to the longitudinal central axis of the main adhesive passage 46. The longitudinal central axes of the heater passages 92 and 94 are disposed in a vertical plane which is disposed between the modular dispenser guns 44 and a vertical plane containing the longitudinal central axis of the main adhesive passage 46. This enables heat to be conducted from the heater passages 92 and 94 to heat adhesive in the main adhesive passage 46 and to heat the modular dispenser guns 44.

Figure 4:
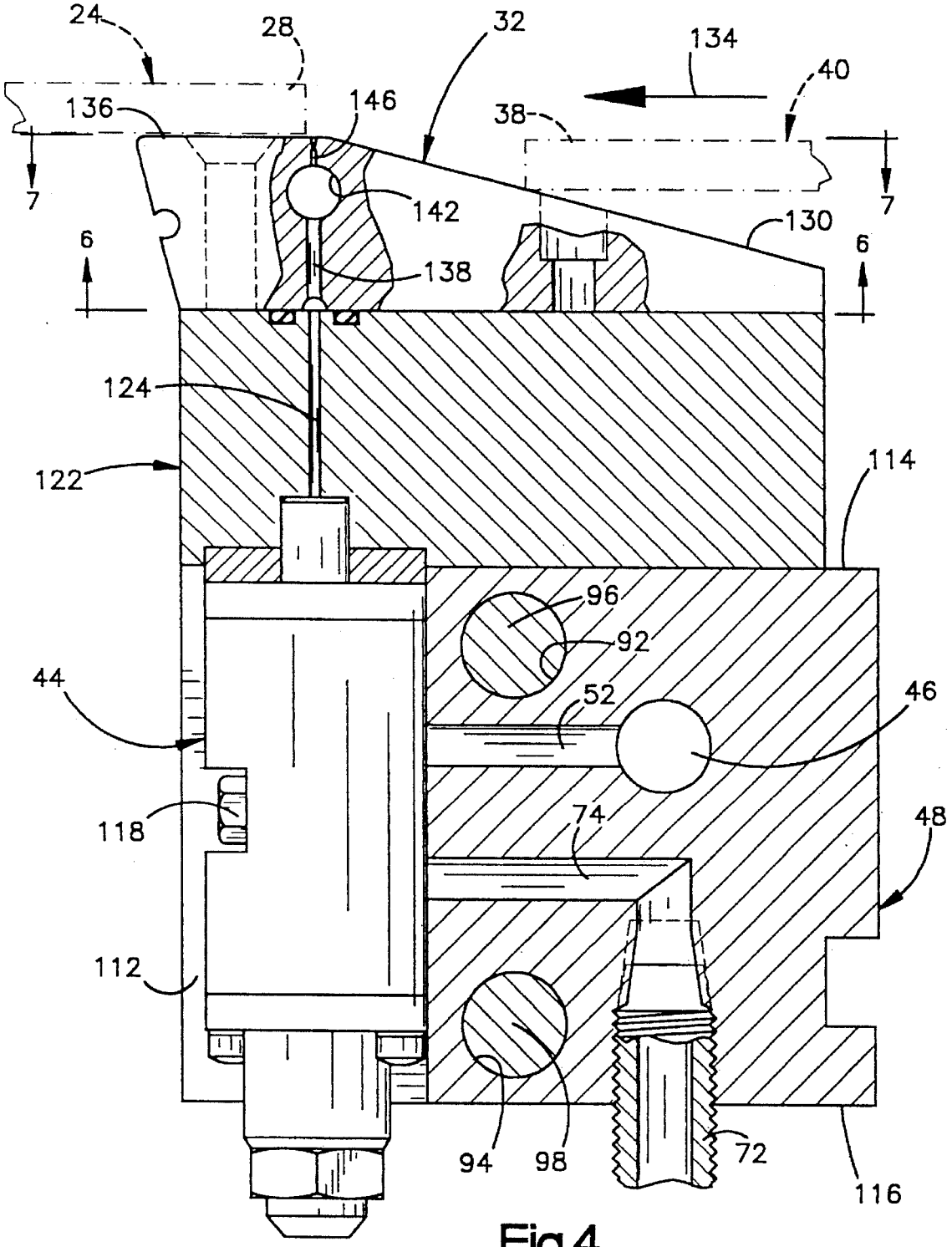
FIG. 4 is a sectional view, taken generally along the line 4—4 of FIG. 2, illustrating the relationship of a modular dispenser gun to the manifold and adhesive dispenser head.

Electrical heater elements are disposed in the heater passages 92 and 94. In the illustrated embodiment of the invention, there are four electrical heater elements in the manifold 48. Thus, a cylindrical heater element 96 (FIG. 3) is mounted in the left (as viewed in FIG. 1) end portion of the passage 92 (FIG. 4). A second heater element (not shown) is mounted in the right end portion of the passage 92. Similarly, a heater element 98 (FIG. 3) is mounted in the left (as viewed in FIG. 1) end portion of the passage 94 (FIG. 4). A second heater element (not shown) is mounted in the right end portion of the passage 94.

Electrical wiring 102 (FIG. 3) for the heater elements 96 and 98 is disposed in a passage 104 formed in the metal block of the manifold 48. The electrical wiring 102 for the heater elements extends lengthwise along the manifold 48 to an electrical connection 106 (FIG. 1) at an end portion of the manifold. A temperature sensor 108 is mounted in the metal block of the manifold 42 to sense the temperature of the manifold. If the temperature of the manifold 48 falls below a predetermined temperature, the sensor 108 effects energization of the heater elements 96 and 98 to effect the transfer of additional heat to the manifold 48. Wiring (not shown) for the heater elements at the right ends (as viewed in FIG. 1) of the passages 92 and 94 also extends to the electrical connection 106.

A plurality of vertically extending rectangular recesses 112 are formed in the metal block of the manifold 48 to receive the modular dispenser guns 44 (FIGS. 4 and 8). The rectangular recesses 112 extend between a horizontal upper side surface 114 of the manifold 48 and a horizontal lower side surface 116 of the manifold. The rectangular recesses 112 have a generally U-shaped cross sectional configuration as viewed in horizontal plane in FIGS. 4 and 8.

There is a modular dispenser gun 44 associated with each of the adhesive dispenser heads 32 and each of the string dispenser heads 34. Therefore, there is a recess 112 formed in the manifold 48 for each of the adhesive dispenser heads 32 and each of the string dispenser heads 34. In the specific embodiment of the invention illustrated in FIGS. 1 and 2, there are nine recesses 112 formed in the manifold 48 of the applicator assembly 14. Six of the recesses 112 are associated with adhesive dispenser heads 32. The other three recesses are associated with string dispenser heads 34.

Each of the modular dispenser guns 44 is disposed in one of the recesses 112 and is connected with the manifold 48 by suitable fasteners, that is, bolts 118. The bolts 118 extend through the modular dispenser guns 44 into threaded openings formed in the manifold 48. The modular dispenser guns 44 are mounted in the recesses 112 with parallel longitudinal central axes of the valves 58 (FIG. 10) in a single vertical plane which extends parallel to a vertical plane containing the central axis of the manifold 48.

Adapter Blocks

The adhesive dispenser heads 32 and the string dispenser heads 34 (FIGS. 4 and 8) are mounted on rectangular aluminum adapter blocks 122 which extend upwardly from the aluminum manifold 48. The adapter blocks 122 support the adhesive dispenser heads 32 and string dispenser heads 34 above the manifold 48. The adapter blocks 122 provide space for the chains 26 (FIGS. 1 and 2) to move between the lower side of the veneer sections and the upper side 114 of the manifold 48.

The adapter blocks 122 are connected directly to the manifold 48. The adhesive dispenser heads 32 (FIG. 4) and string dispenser heads 34 (FIG. 8) are connected directly to the adapter blocks 122. Therefore, an adhesive dispenser head 32 or a string dispenser head 34 can be replaced without replacing the associated adapter block 122.

The adapter blocks 122 have vertically extending adhesive passages 124. Adhesive is conducted upwardly from the modular dispenser guns 44 through the passages 124 to the adhesive dispenser head 32 (FIG. 4) or the string dispenser head 34 (FIG. 8).

Two different size adapter blocks 122 are provided. A relatively small adapter block 122 is provided to support only an adhesive dispenser head 32. A somewhat larger adapter block 122 is provided to support both an adhesive dispenser head 32 and a string dispenser head 34. The adapter blocks which are sized to support only an adhesive dispenser head 32, have only a single vertical passage 124. The adapter blocks 122 which are sized to support both an adhesive dispenser head 32 and a string dispenser head 34, have a pair of parallel and spaced apart vertical adhesive passages 124. It should be understood that the vertical height of an adapter block for just an adhesive dispenser head 34 is the same as the vertical height of an adapter block for both an adhesive dispenser head 32 and a string dispenser head 34.

Adhesive Dispenser Head

Figure 2:
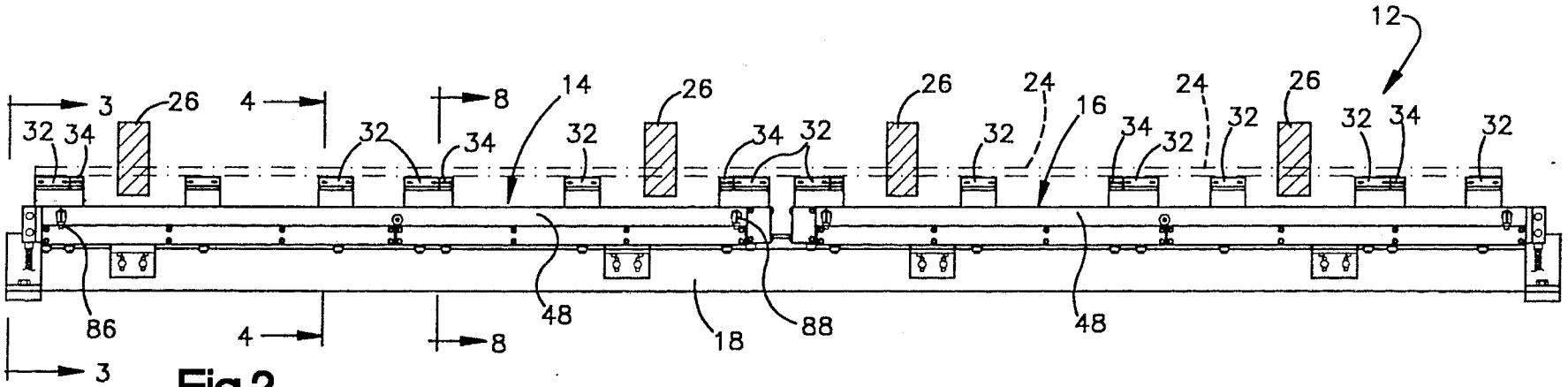
FIG. 2 is a front elevational view, taken generally along the line 2—2 of FIG. 1, further illustrating the construction of the apparatus.

The construction of the steel adhesive dispenser head 32 is illustrated in FIGS. 4–7. The steel adhesive dispenser head 32 has an inclined upper side surface 130 (FIGS. 4 and 5) which is skewed at an acute angle approximately 15° to a horizontal plane. The inclined upper side surface 130 of the adhesive dispenser head 32 is engaged by the leading end portion 38 of a veneer section 40. The leading end portion 38 of the veneer section 40 is cammed upwardly by the inclined upper side surface 130 of the adhesive dispenser head 32 as the veneer section is moved onto the adhesive dispenser head, in the direction of the arrow 134 in FIG. 4, by the chains 26 (FIGS. 1 and 2).

Figure 5:
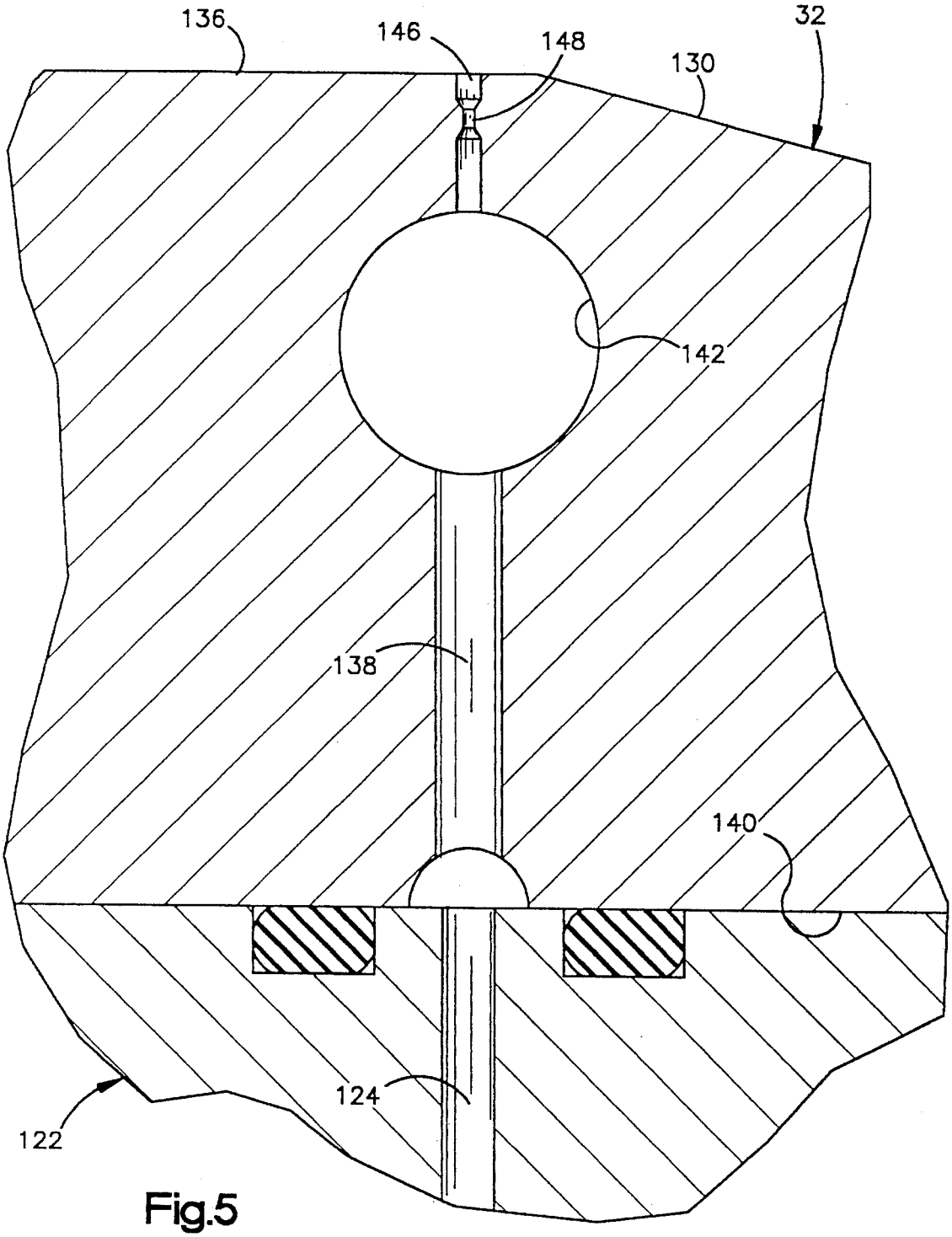
FIG. 5 is an enlarged fragmentary sectional view of a portion of FIG. 4.
Figure 6:
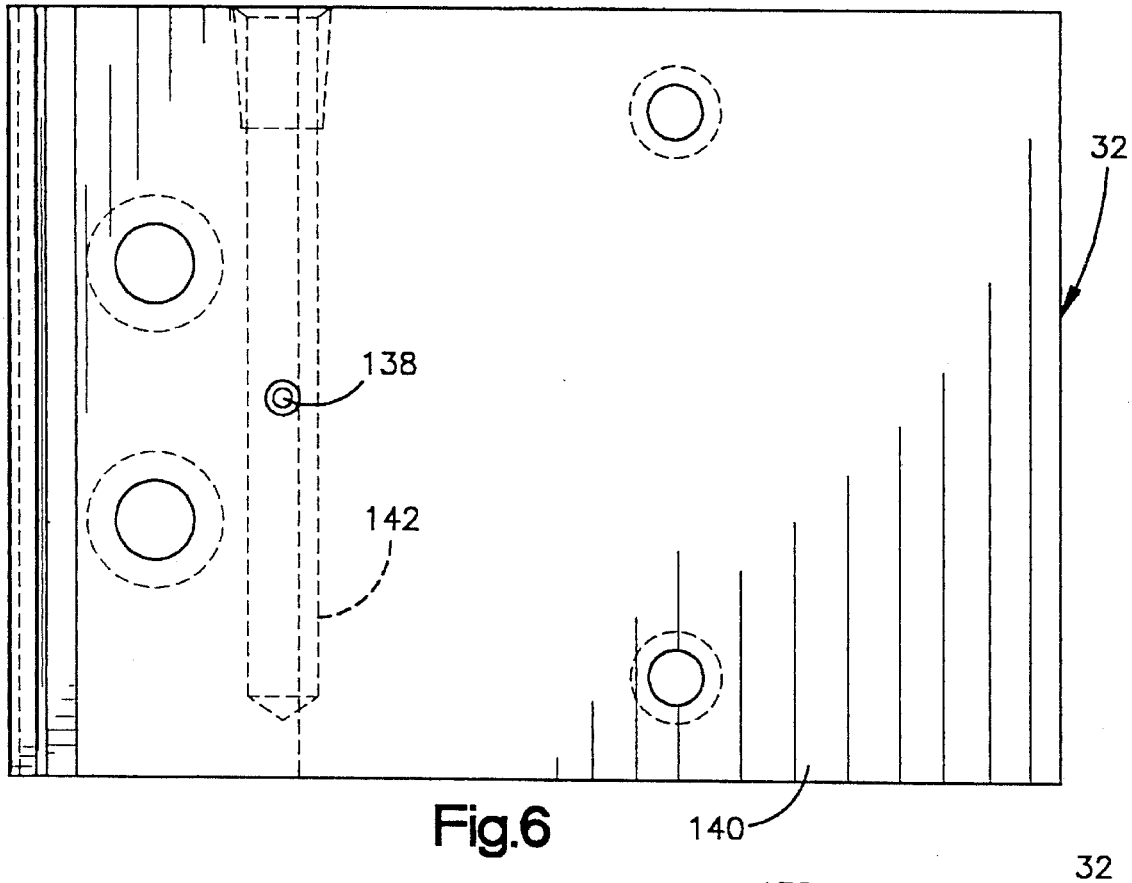
FIG. 6 is a plan view, on a somewhat enlarged scale and taken along the line 6—6 of FIG. 4, illustrating a bottom side of the adhesive dispenser head.
Figure 7:
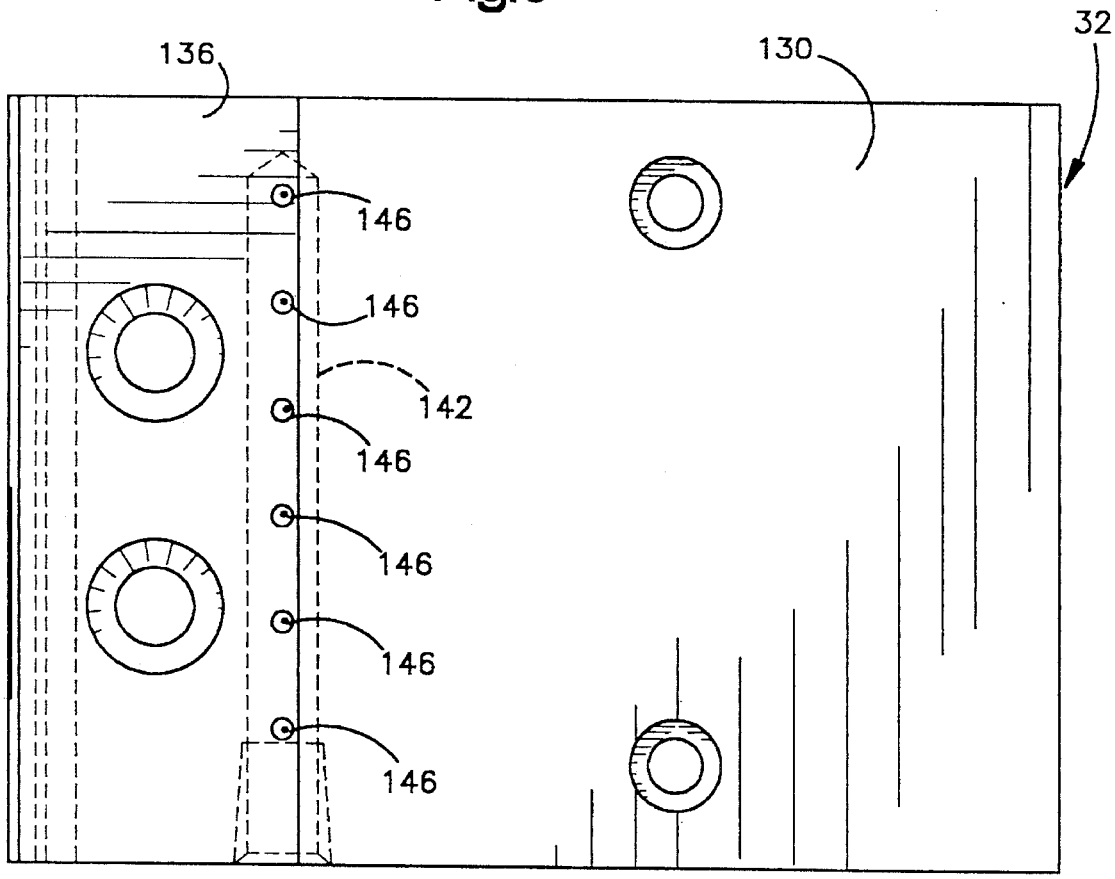
FIG. 7 is a plan view, on a somewhat enlarged scale and taken generally along the line 7—7 of FIG. 4, illustrating an upper side of the adhesive dispenser head.

The adhesive dispenser head 32 also has a horizontal upper side surface 136 (FIGS. 4 and 5). The horizontal upper side surface 136 of the adhesive dispenser head 32 is engaged by a trailing end portion 38 of a stationary veneer section 24 which is to be secured to the next succeeding veneer section 40 by adhesive.

An adhesive passage 138 in the adhesive dispenser head 32 extends vertically upwardly from a flat horizontal lower side surface 140 of the adhesive dispenser head 32 (FIGS. 5 and 6) to a cylindrical adhesive chamber 142 (FIGS. 4–7) formed in the adhesive dispenser head. Therefore, adhesive from the modular dispenser gun 44 (FIG. 4) flows directly upwardly through the passage 124 in the adapter block 122 and through the passage 138 in the adhesive dispenser head 32 to the adhesive chamber 142. The cylindrical adhesive chamber 142 has a horizontal central axis which extends parallel to the central axis of the manifold 48.

A plurality of adhesive outlet passages 146 (FIGS. 5 and 7) are disposed in a linear array and extend between the cylindrical adhesive chamber 142 and the horizontal upper side 136 of the adhesive dispenser head 32. The adhesive outlet passages 146 intersect the horizontal upper side 136 of the adhesive dispenser head 32 at a location just past an intersection between the inclined upper side 130 of the adhesive dispenser head and the horizontal upper side of the adhesive dispenser head. Adhesive flow is controlled by the size of the diameter and the length of the passages 146. The outer end of the adhesive chamber 142 is blocked by a suitable plug.

Upon movement of the valve member 58 (FIG. 10) in the modular dispenser gun 44 to an open position by the pneumatic actuator 66, hot thermoplastic adhesive flows upwardly from the modular dispenser gun through the adhesive passage 124 (FIG. 4) in the adapter block 22. The hot adhesive flows from the adapter block passage 124 upwardly through the passage 138 (FIG. 5) in the adhesive dispenser head 32 to the adhesive chamber 142. The adhesive then flows upwardly from the chamber 142 through the linear array of outlet passages 146 (FIG. 7) to the upper side of the adhesive dispenser head 32.

As the adhesive leaves the outlet passages 146, the leading end portion 38 of the veneer section 40 (FIG. 4) is approaching the stationary trailing end portion 28 of the preceding veneer section 24. The adhesive which is dispensed from the outlet passages 146 is pressed between the trailing end portion 28 of the veneer section 24 and the leading end portion 38 of the veneer section 40. As the thermoplastic adhesive cools, it interconnects the two veneer sections 24 and 40.

String Dispenser Head

Figure 9:
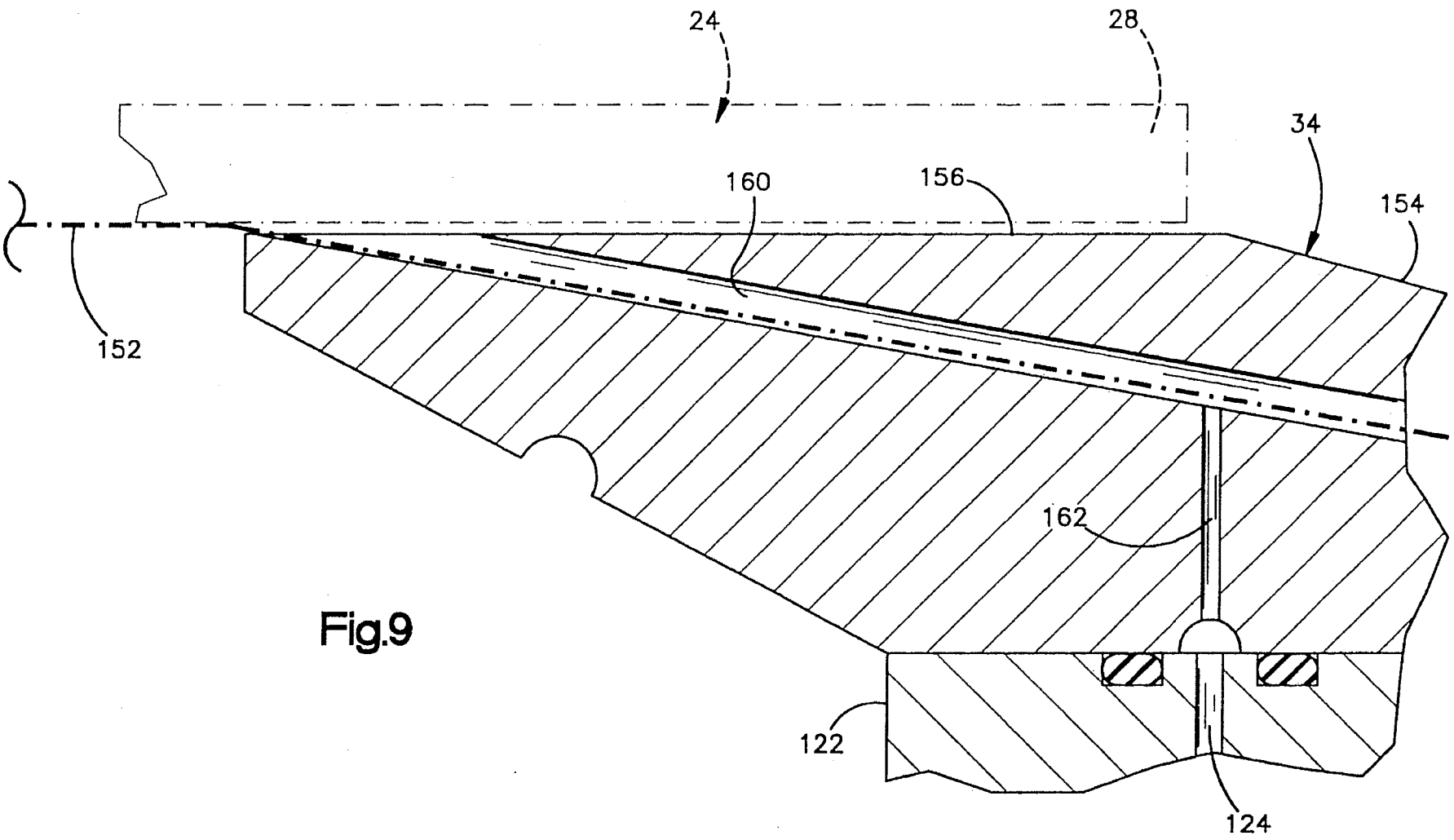
FIG. 9 is an enlarged fragmentary sectional view of a portion of FIG. 8.

A string, indicated schematically at 42 in FIG. 9, is coated with hot thermoplastic adhesive and is withdrawn from the string dispenser head 34 as the veneer sections 24 and 40 move forwardly together. The adhesive coated string 42 is pressed against downwardly facing major side surfaces of the veneer sections. The adhesive coating on the string 42 secures the string to the veneer sections and reinforces the veneer sections. The string 42 extends across the joints between the veneer sections to interconnect the veneer sections. In addition, the string 42 and associated adhesive reinforces the veneer sections to prevent breaking apart of the veneer sections along grain lines.

The steel string dispenser head 34 has an inclined upper side surface 154 (FIGS. 8 and 9) which engages the leading end portion 38 of a veneer section 40. The inclined upper side surface 154 raises the leading end portion 38 (FIG. 8) of the veneer section 40 upwardly toward the trailing end portion 28 of a next preceding veneer section 24. The inclined upper side surface 154 of the steel string dispenser head 34 is skewed at an angle of approximately 15° to a horizontal plane.

In addition, the string dispenser head 34 has a horizontal upper side surface 156 which intersects the inclined upper side surface 154. The horizontal upper side surface 156 of the string dispenser head 34 supports the stationary veneer section 24. The upper side surfaces 154 and 156 on the string dispenser head 34 are disposed along side of and form extensions of the upper side surfaces 130 and 136 (FIG. 4) on an adhesive dispenser head 32. However, the string dispenser heads 34 could be mounted separately from the adhesive dispenser heads 32 if desired.

A cylindrical string passage 160 extends through the string dispenser head 34. The string passage 160 extends at an angle of approximately 10° to a horizontal plane. As the string 42 moves through the passage 160, the hot thermoplastic adhesive is applied to the string. The string passage 160 is connected with a modular dispenser gun 44 through the adhesive passage 124 in the adapter block 122 and through an adhesive passage 162 (FIGS. 8 and 9) formed in the string dispenser head 34.

Upon operation of the modular dispenser gun 44 (FIG. 8) to an open or actuated condition, adhesive under pressure flows upwardly from the modular dispenser gun through the passage 124 in the adapter block 22 and through the passage 162 in the string dispenser head 34 to the string passage 160. The rate of flow of adhesive is such that, as the string 42 is pulled through the string passage 160, the adhesive is drawn out of the passage with the string.

When the veneer section 24 is stationary on the string dispenser head 34, the modular dispenser gun 44 is maintained in a closed or unactuated condition. As soon as the veneer section 24 begins to move forwardly relative to the string dispenser head 34 with the veneer section 40, the modular dispenser gun 44 is actuated to an open condition. This causes hot thermoplastic adhesive to flow into the string passage 160 and to coat the string 42.

Although it is preferred to use the string dispenser heads 34 in combination with the adhesive dispenser heads 32, either set of dispenser heads could be used without the other if desired. Thus, the apparatus 12 could have adhesive dispenser heads 32 and no string dispenser heads 34 if desired. On the other hand, the apparatus 12 could have string dispenser heads 34 and no adhesive dispenser heads 32 if desired.

Heat Conductors

In the embodiments illustrated in FIGS. 1–10, heat is conducted from the cylindrical heater elements 96 and 98 disposed in the heater passages 92 and 94 in the manifold 48 through the adaptor block 122 to the adhesive dispenser head 32. However, the distribution of heat to the adhesive dispenser head 32 may be impaired due to the relatively low thermal conductivity of the aluminum manifold 48 and the aluminum adaptor block 122. In accordance with a feature of the embodiment of the invention illustrated in FIGS. 11 and 12, the distribution of heat to the adhesive dispenser head 32 is improved by heat conductors 200 and 202 (FIGS. 11 and 12).

The heat conductors 200 and 202 are formed of a material having a greater thermal conductivity than the manifold 48 and the adaptor block 122. Thus, in the specific embodiment of the invention illustrated in FIGS. 11 and 12, the heat conductors 200 and 202 are formed of copper which has a greater thermal conductivity than the aluminum manifold 48 and the aluminum adaptor block 122. The relatively large heat flow rate through the heat conductor 200 improves the distribution of heat in the steel dispenser head 32.

The copper material of the heat conductors 200 and 202 has a thermal conductivity of approximately 2,680 BTU in/hr $ft^2$ F. deg. or 0.92 cal/sec cm C. deg. The aluminum material of the manifold 48 and adaptor block 122 has a thermal conductivity of approximately 1,390 BTU in/hr $ft^2$ F. deg. or 0.48 cal/sec cm C. deg. Thus, the copper material of the heat conductor 200 has a thermal conductivity which is almost twice as great as the thermal conductivity of the aluminum material forming the manifold 48 and the adaptor block 122. This enables heat to be conducted at a relatively high rate from the heater elements 96 and 98 to the adhesive dispenser head 32. It should be understood that the heat conductors 200 and 202 could be formed of a material other than copper and that the manifold 48 and adapter 122 could be formed of a material other than aluminum.

Figure 11:
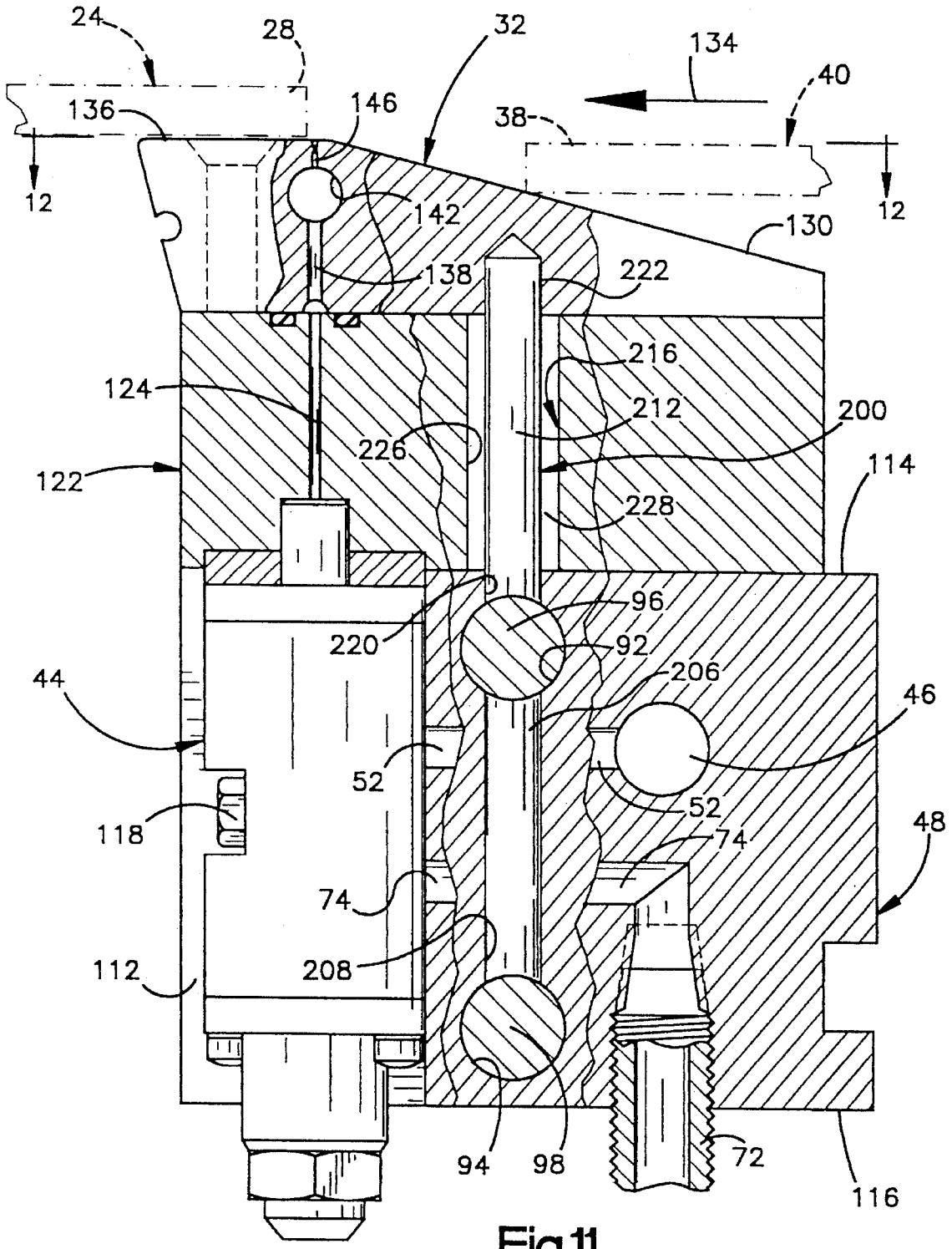
FIG. 11 is a sectional view, generally similar to FIG. 4, illustrating an embodiment of the invention having a heat conductor to conduct heat from a manifold to an adhesive dispenser head.
Figure 12:
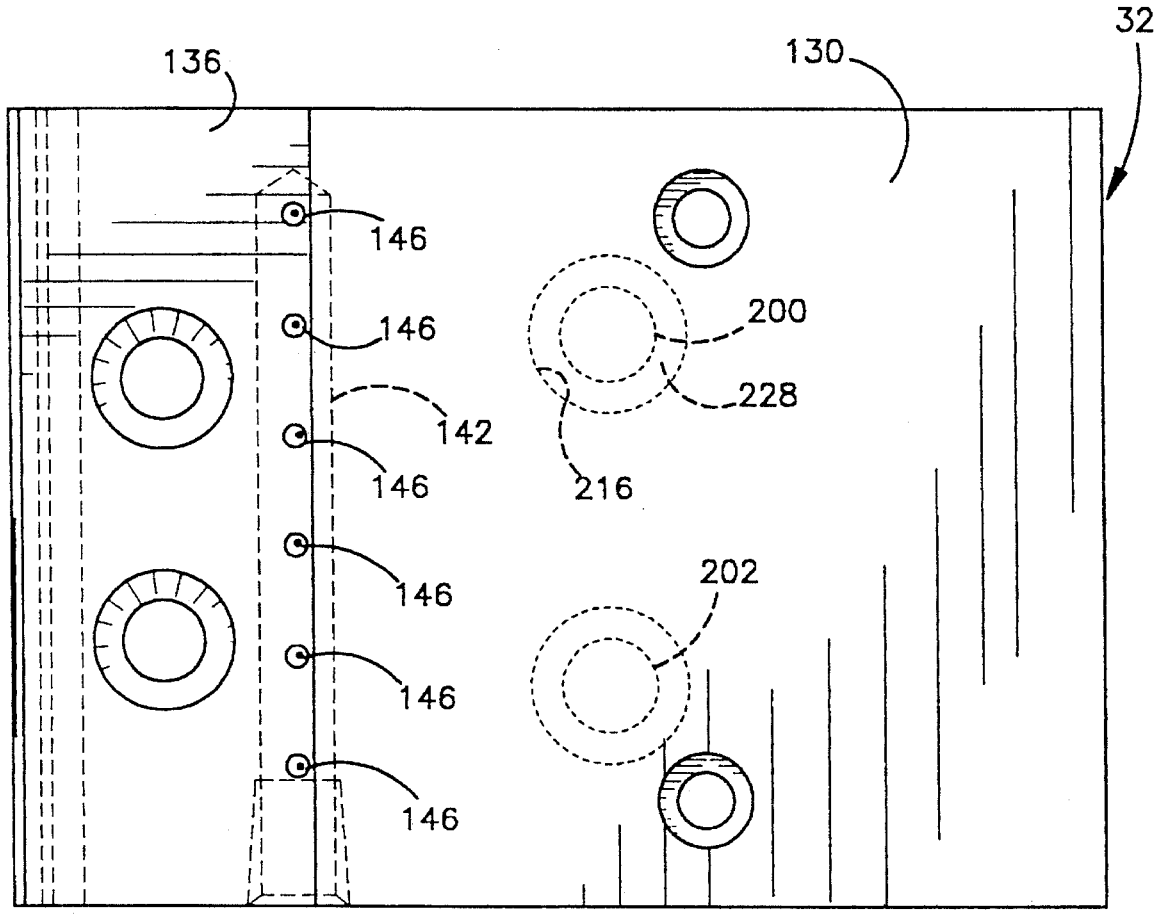
FIG. 12 is a plan view, on a somewhat enlarged scale and taken generally along line 12—12 of FIG. 11.

In the embodiment of the invention illustrated in FIG. 11, the heat conductor 200 is formed by a pair of members. Thus, the heat conductor 200 includes a cylindrical lower member or rod 206 which is formed of copper and extends between and engages the heater elements 96 and 98. The lower member or rod 206 is disposed in a cylindrical heat conductor passage 208 which extends between the heater passages 92 and 94 and has a central axis which extends perpendicular to and intersects the central axes of the heater passages 92 and 94.

The heat conductor 200 also includes a cylindrical upper member or rod 212 which is formed of copper and extends from the upper heater element 96 through a portion of the manifold 48, through the adaptor block 122, and into the adhesive dispenser head 32. The upper member or rod 212 is disposed in a cylindrical heat conductor passage 216 which extends from the upper heater element 96 through the adaptor block 122 into the adhesive dispenser head 32. The heat conductor passage 216 has a central axis which is coincident with the central axis of the heat conductor passage 208 and extends perpendicular to and intersects the central axes of the heater passages 92 and 94 in the manifold 48.

The lower (as viewed in FIG. 11) end portion of the upper heat conductor member or rod 212 engages the upper heater element 96. The upper end portion of the upper heat conductor member or rod 212 engages the adhesive dispenser head 32. Therefore, the heat conductor member 212 provides a direct path for transfer of heat from the upper heater element to the adhesive dispenser head.

The heat conductor passage 216 has a cylindrical lower portion 220 which is formed in the aluminum manifold 48 and intersects the heater passage 92 to enable the upper member 212 to engage the heater element 96. The heat conductor passage 216 also has an upper portion 222 with a central axis which is coincident with the central axis of the lower portion 220 of the heat conductor passage. The upper portion 222 of the heat conductor passage 216 has a cylindrical configuration and has the same diameter as the lower portion 220 of the heat conductor passage 216.

A central portion 226 of the heat conductor passage 216 is formed in the aluminum adaptor block 122. The central portion 226 of the heat conductor passage 216 has a cylindrical configuration and has a central axis which is coincident with the central axes of the lower portion 220 and upper portion 222 of the heat conductor passage. However, the central portion 226 of the heat conductor passage 216 has a diameter which is larger than the diameter of the lower portion 220 and the upper portion 222 of the heat conductor passage. Thus, the upper and lower portions 220 and 222 of the heat conductor passage 216 have substantially the same diameter as the cylindrical upper heat conductor member or rod 212. The central portion 226 of the heat conductor passage 216 has a diameter which is greater than the diameter of the cylindrical upper heat conductor member or rod 212. This results in a dead air space 228 between the adaptor block 122 and the heat conductor 200.

The dead air space 228 has an annular configuration and extends completely around the upper heat conductor member or rod 212. The dead air space 228 insulates the upper heat conductor member or rod 212 from the adaptor block 122. The insulating effect of the dead air space 228 retards the transfer of heat from the upper heat conductor member or rod 212 to the adaptor block 122 and thereby promotes the transfer of heat from the heater elements 96 and 98 to the adhesive dispenser head 32.

Although only the construction of the heat conductor 200 is illustrated in FIG. 11, it should be understood that the heat conductor 202 has the same construction as the heat conductor 200. The longitudinal central axes of the heat conductors 200 and 202 are disposed in a vertical plane which extends perpendicular to the horizontal lower side surface 116 of the manifold 48. The vertical plane 116 in which the central axes of the heat conductors 200 and 202 are disposed is the same as the vertical plane in which the central axes of the heater elements 96 and 98 are disposed and extends parallel to the longitudinal central axes of the valve 58 (FIG. 10) in the modular dispenser guns 44.

In the embodiment of the invention illustrated in FIG. 11, the manifold 48, adaptor block 122 and adhesive dispenser head 32 are formed separately from each other. It is contemplated that the manifold 48 and adaptor block 122 could be formed from a single piece of metal if desired. It is also contemplated that the adhesive dispenser head 32 could be formed as a single piece of metal with the adaptor block 122. Regardless of whether the manifold 48, adaptor block 122 and adhesive dispenser head 32 are formed as separate elements, as shown in FIG. 11, or as a single element, the heat conductors 200 will have a thermal conductivity which is substantially greater than the thermal conductivity of the manifold 48 and adaptor block 122 to promote a transfer of heat from the heater elements 96 and 98 to the adhesive dispenser head 32.

During construction of the apparatus 10, it is contemplated that a pair of parallel passages for the heat conductor elements 200 and 202 may be drilled in the manifold 48 before the heater element passages 92 and 94 are formed in the manifold 48. Once the passages for the heater elements 200 and 202 have been formed, the heater elements 200 and 202 would be inserted into the parallel passages in the manifold 48. The heater element passages 92 and 94 could then be drilled through the manifold block and through the heat conductors 200 and 202. This will result in abutting engagement of the heat conductors 200 and 202 with the heater elements 96 and 98 when the heater elements are inserted into the heater element passages 92 and 94.

The distribution of heat from the heater elements 96 and 98 in the manifold 48 to the string dispenser heads 44 is also enhanced by heat conductors. Thus, a heat conductor 240 (FIG. 13) extends from the heater elements 96 and 98 in the manifold 48 through the adaptor block 122 to the string dispenser head 34. The heat conductor 240 has the same construction as the heat conductor 200 of FIG. 11. Thus, the heat conductor 240 is formed of a material which has a greater thermal conductivity than the thermal conductivity of the manifold 48 and adaptor block 122. In the specific embodiment of the invention illustrated in FIG. 13, the heat conductor 240 is formed of copper while the manifold 48 and adaptor block 122 are formed of aluminum. The heat conductor 240 includes a cylindrical lower member or rod 246 which is disposed in a lower heat conductor passage 248 which extends between the heater element passages 92 and 94. The cylindrical lower heat conductor passage 248 has a central axis which extends perpendicular to and intersects the central axes of the heater passages 92 and 94.

The heat conductor 240 also includes a cylindrical upper member or rod 252. The upper member or rod 252 extends between the heater element 96 in the manifold 48 and the string dispenser head 34. The upper member or rod 252 is disposed in a cylindrical heat conductor passage 256. The heat conductor passage 256 has a central axis which is coincident with the central axis of the heat conductor passage 248. The heat conductor passage 256 is disposed in a vertical plane which contains the central axes of the heater passages 92 and 94.

The heat conductor passage 256 includes a cylindrical lower portion 260 which is formed in the manifold 48 and which intersects the heater passage 92. The heat conductor passage 256 also includes a cylindrical upper portion 262 which is disposed in the string dispenser head 34 and has a central axis which is coincident with the central axis of the lower portion 248 of the heat conductor passage 256.

A central portion 266 of the heat conductor passage 256 has a cylindrical configuration and has a diameter which is greater than the diameter of the cylindrical upper heat conductor member or rod 252. This results in a dead air space 268 being formed between the upper heat conductor member or rod 252 and the adaptor block 122. The dead air space 268 extends completely around the upper heat conductor member or rod 252 and insulates the upper heat conductor member or rod from the adaptor block 122.

Figure 13:
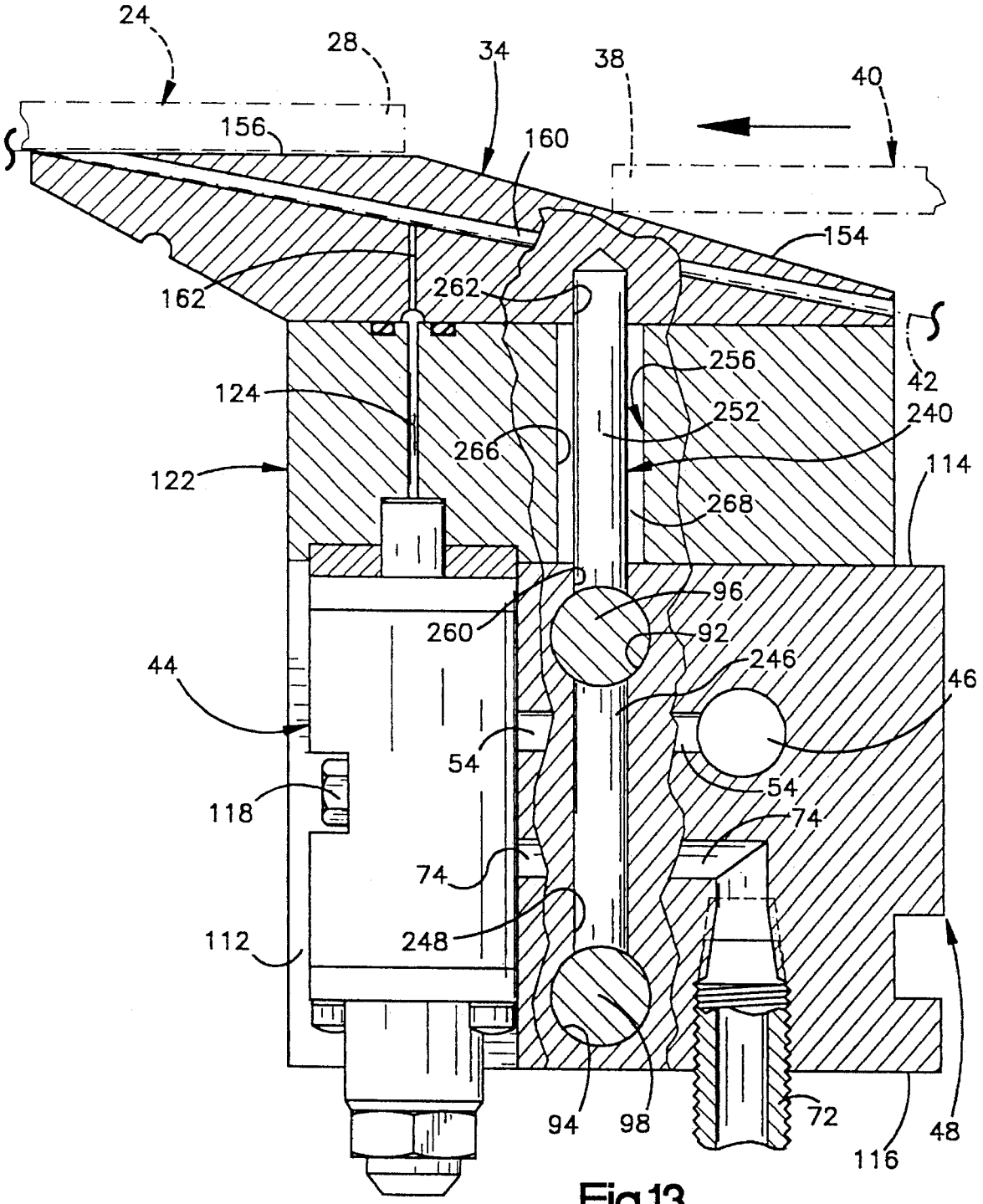
FIG. 13 is a sectional view, generally similar to FIG. 8, illustrating an embodiment of the invention having a heat conductor to conduct heat from a manifold to a string dispenser head.

Although only a single heat conductor 240 is illustrated in FIG. 13, it should be understood that a pair of heat conductors could be associated with the string dispenser head 34, in the same manner as in which the pair of heat conductors 200 and 202 are associated with the adhesive dispenser head 32. Although the manifold block 48 and adaptor block 122 and string dispenser head 34 are three separate elements in the illustrated embodiment of the invention, it is contemplated that they could be formed as one or more elements if desired.

In the embodiment of the invention illustrated in FIG. 11, the heat conductor 200 is formed with a lower heat conductor member or rod 206 which extends between the heater elements 96 and 98 and an upper heat conductor member or rod 212 which extends between the upper heater element 96 and the adhesive dispenser head 32. In the embodiment of the invention illustrated in FIG. 14, a heat conductor 280 extends between the manifold 48 and the adhesive dispenser head 32 to improve the distribution of heat to the heat dispenser head. The heat conductor 280 has a thermal conductivity which is greater than the thermal conductivity of the manifold 48 and the thermal conductivity of the adaptor block 122. This results in the heat conductor 280 promoting a transfer of heat from a heater element 96 in the manifold 48 to the adhesive dispenser head 32. Although the heat conductor 280 could be formed of many different materials, in the illustrated embodiment of the invention, the heat conductor 280 is formed of copper while the manifold 48 and adaptor block 122 are formed of aluminum.

The heat conductor 280 includes a single cylindrical member or rod 284 which extends from the manifold 48 through the adaptor block 122 to the adhesive dispenser head 32. The heat conductor member or rod 284 is formed of copper. A cylindrical opening 286 is formed in the lower (as viewed in FIG. 14) end portion of the heat conductor member or rod 284 and receives the heater element 96. The cylindrical opening 286 has a central axis which is coincident with the central axis of the heater element passage 92.

The copper heat conductor member or rod 284 is disposed in a cylindrical heat conductor passage 290. The heat conductor passage 290 has a cylindrical lower end portion 292 which is disposed in the manifold 48. The heat conductor passage 290 also has a cylindrical upper portion 294 which is disposed in the adhesive dispenser head 32. A cylindrical central portion 296 of the heat conductor passage 290 has a diameter which is greater than the diameter of the cylindrical heat conductor member or rod 284. This results in the formation of a dead air space 298 between the outer side surface of the heat conductor member or rod 284 and the central portion 296 of the heat conductor passage 290. The dead air space 298 insulates the aluminum adaptor block 122 from the copper heat conductor member or rod 284.

Figure 14:
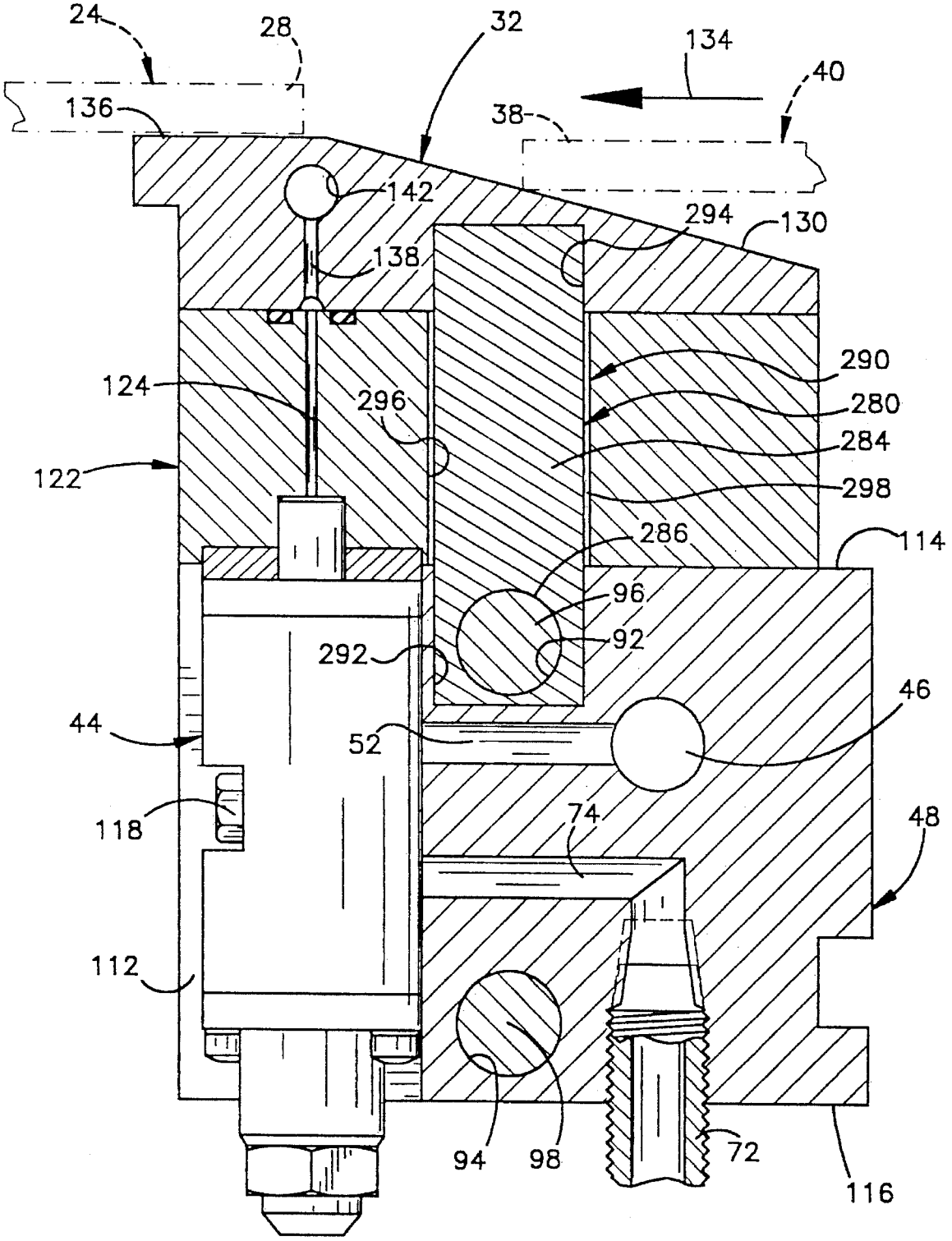
FIG. 14 is a sectional view, generally similar to FIG. 11, illustrating another embodiment of the heat conductor which conducts heat from the manifold to the adhesive dispenser head.

In the embodiment of the invention illustrated in FIG. 14, there is a single heat conductor 280 which extends upwardly from the manifold 48 to the adhesive dispenser head 32. If desired, a plurality of heat conductors 280 could be provided in association with the adhesive dispenser head 32.

Conclusion

The present invention provides a new and improved apparatus 12 for use in forming core layers for plywood from a plurality of veneer sections 24 and 40. The apparatus 12 includes a manifold 48 across which the veneer sections are sequentially moved. A main adhesive passage 46 extends along the manifold 48.

A plurality of adhesive dispenser heads 32 and string dispenser heads 34 are disposed along the manifold 48. Each of the adhesive dispenser heads 32 includes an outlet 146 from which adhesive to be engaged by end portions 28 and 38 of the veneer sections is dispensed. Each of the string dispenser heads 34 includes a passage 160 from which a string 42 coated with adhesive is dispensed to interconnect and reinforce the veneer sections.

A plurality of heat conductors 200, 202 and 240 are provided to conduct heat from heaters 96 and 98 in the manifold 48 to the adhesive dispenser heads 32 and the string dispenser heads 34. The heat conductors 200, 202 and 240 have a greater thermal conductivity than the manifold 28. Thus, the heat conductors 200, 202 and 240 may, for example, be formed of copper and the manifold 28 of aluminum.

Having described the invention, the following is claimed:

1. An apparatus for use in forming core layers for plywood from a plurality of veneer sections, said apparatus comprising a manifold portion extending transversely to a work flow path of the veneer sections and across which the veneer sections are sequentially moved, adhesive passage means extending along said manifold portion transversely to the work flow path of the veneer sections, a plurality of adhesive dispenser head portions disposed above and connected with said manifold portion, each of said adhesive dispenser head portions including outlet means for dispensing adhesive to be engaged by a leading end portion of one veneer section and pressed against a trailing end portion of a next preceding veneer section, valve means connected in fluid communication with said adhesive passage means and said outlet means in said adhesive dispenser head portions for controlling flow of adhesive between said adhesive passage means and said adhesive dispenser head portions, heater means disposed in and extending along said manifold portion transversely to the work flow path of the veneer sections for heating the adhesive in said adhesive passage means, and a plurality of heat conductor means for transmitting heat from said heater means to said plurality of adhesive dispenser head portions, each of said heat conductor means extending from said heater means into one of said adhesive dispenser head portions, each of said heat conductor means having a thermal conductivity which is greater than the thermal conductivity of said manifold portion to promote a transfer of heat from said heater means to one of said adhesive dispenser head portions.

2. An apparatus as set forth in claim 1 further including a plurality of surface means extending around and spaced from portions of said heat conductor means at locations between said heater means and said adhesive dispenser head portions to retard transfer of heat from said heat conductor means at the locations between said heater means and said adhesive dispenser head portions.

3. An apparatus as set forth in claim 1 wherein said manifold portion is formed of a first metal having a first thermal conductivity and said plurality of heat conductor means are formed of a second metal having a second thermal conductivity which is greater than said first thermal conductivity.

4. An apparatus as set forth in claim 1 wherein said heater means includes a longitudinally extending heater element disposed in said manifold portion and extending beneath said plurality of adhesive dispenser head portions, each of said heat conductor means including a body of material which extends upward from said heater element to one of said adhesive dispenser head portions.

5. An apparatus as set forth in claim 1 wherein said heater means includes first and second longitudinally extending heater elements which are spaced apart from each other and extend beneath said plurality of adhesive dispenser head portions, each of said heat conductor means extends upward from said first and second heater elements to one of said adhesive dispenser head portions.

6. An apparatus as set forth in claim 5 wherein each of said heat conductor means includes a first body of material which extends between said first and second heater elements and a second body of material which extends upward from one of said heater elements to one of said adhesive dispenser head portions.

7. An apparatus as set forth in claim 1 wherein said manifold portion is formed of aluminum, and each of said heat conductor means is formed of copper.

8. An apparatus as set forth in claim 1 further including a plurality of string dispenser head portions disposed above and connected with said manifold portion, each of said string dispenser head portions including string passage means for receiving string to be secured by adhesive to veneer sections as said veneer sections move along the work flow path, valve means connected in fluid communication with said adhesive passage means and said string passage means for controlling flow of adhesive between said adhesive passage means and said string passage means, and a second plurality of heat conductor means for transmitting heat from said heater means to said plurality of string dispenser head portions, each of said heat conductor means of said second plurality of heat conductor means having a greater thermal conductivity than said manifold portion to promote a transfer of heat from said heater means to one of said string dispenser head portions.

9. An apparatus as set forth in claim 1 wherein said heater means includes surface means for defining a longitudinally extending heater passage which extends between opposite end portions of said manifold portion in a direction transverse to the work flow path of the veneer sections and an elongated heater element disposed in said heater passage, each of said plurality of heat conductor means including surface means for defining a heat conductor passage which extends transverse to and intersects said heater passage and a heat conductor element which is disposed in said heat conductor passage and is formed of a material having a greater thermal conductivity than said manifold portion.

10. An apparatus as set forth in claim 9 wherein said heat conductor passage has a central axis which extends perpendicular to a central axis of said heater passage.

11. An apparatus as set forth in claim 1 wherein said valve means includes a plurality of valve members movable between a closed condition blocking flow of adhesive from said adhesive passage means to said outlet means in said adhesive dispenser head portions and an open condition enabling adhesive to flow from said adhesive passage means to said outlet means in said adhesive dispenser head portions, and a plurality of actuator means for effecting movement of said valve members between the open and closed conditions, each of said actuator means of said plurality of actuator means being connected with one of said valve members and being operable to move said one valve member of said plurality of valve members.

12. An apparatus as set forth in claim 1 wherein said valve means includes a plurality of modular units disposed along said manifold portion, each of said modular units including a housing connected with said manifold portion, a valve disposed in said housing and connected in fluid communication with said adhesive passage means and said outlet means in one of said adhesive dispenser head portions, said valve being movable between a closed condition blocking flow of adhesive from said adhesive passage means to said outlet means in said one of said adhesive dispenser head portions and an open condition enabling adhesive to flow from said adhesive passage means to said outlet means in said one of said adhesive dispenser head portions and a valve actuator disposed entirely within said housing and connected with said valve for effecting movement of said valve relative to said housing between the open and closed conditions, said valve actuator in each modular unit of said plurality of modular units being operable independently of valve actuators in other modular units of said plurality of modular units.

13. An apparatus as set forth in claim 1 wherein each of said heat conductor means includes surface means for defining a passage extending through said heat conductor means, said heater means extending through said passage in each of said heat conductor means.

14. An apparatus for use in forming core layers for plywood from a plurality of veneer sections, said apparatus comprising a manifold portion extending transversely to a work flow path of the veneer sections and across which the veneer sections are sequentially moved, adhesive passage means extending along said manifold portion transversely to the work flow path of the veneer sections, a plurality of string dispenser head portions disposed above and connected with said manifold portion, each of said string dispenser head portions including string passage means for receiving string to be secured by adhesive to said veneer sections as said veneer sections are moved along the work flow path, valve means connected in fluid communication with said adhesive passage means and said string passage means in said string dispenser head portions for controlling flow of adhesive between said adhesive passage means and said string passage means, heater means disposed in and extending along said manifold portion transversely to the work flow path of the veneer sections for heating the adhesive in said adhesive passage means, and a plurality of heat conductor means for transmitting heat from said heater means to said plurality of string dispenser head portions, each of said heat conductor means extending from said heater means into one of said string dispenser head portions, each of said heat conductor means having a greater thermal conductivity than said manifold portion to promote a transfer of heat from said heater means to one of said string dispenser head portions.

15. An apparatus as set forth in claim 14 further including a plurality of surface means extending around and spaced from portions of said heat conductor means at locations between said heater means and said string dispenser head portions to retard transfer of heat from said heat conductor means at the locations between said heater means and said string dispenser head portions.

16. An apparatus as set forth in claim 14 wherein said manifold portion is formed of a first metal having a first thermal conductivity and said plurality of heat conductor means are formed of a second metal having a second thermal conductivity which is greater than said first thermal conductivity.

17. An apparatus as set forth in claim 14 wherein said heater means includes a longitudinally extending heater element disposed in said manifold portion and extending beneath said plurality of string dispenser head portions, each of said heat conductor means including a body of material which extends upward from said heater element to one of said string dispenser head portions.

18. An apparatus as set forth in claim 14 wherein said heater means includes first and second longitudinally extending heater elements which are spaced apart from each other and extend beneath said plurality of string dispenser head portions, each of said heat conductor means extends upward from said first and second heater elements to one of said string dispenser head portions.

19. An apparatus as set forth in claim 18 wherein each of said heat conductor means includes a first body of material which extends between said first and second heater elements and a second body of material which extends upward from one of said heater elements to one of said adhesive dispenser head portions.

20. An apparatus as set forth in claim 14 wherein said manifold portion is formed of aluminum, and each of said heat conductor means is formed of copper.

21. An apparatus as set forth in claim 14 wherein said heater means includes surface means for defining a longitudinally extending heater passage which extends between opposite end portions of said manifold portion in a direction transverse to the work flow path of the veneer sections and an elongated heater element disposed in said heater passage, each of said plurality of heat conductor means including surface means for defining a heat conductor passage which extends transverse to and intersects said heater passage and a heat conductor element which is disposed in said heat conductor passage and is formed of a material having a greater thermal conductivity than said manifold portion.

22. An apparatus as set forth in claim 21 wherein said heat conductor passage has a central axis which extends perpendicular to a central axis of said heater passage.

23. An apparatus for use in forming core layers for plywood from a plurality of veneer sections, said apparatus comprising an elongated manifold portion extending transversely to a work flow path of the veneer sections and across which the veneer sections are sequentially moved, said manifold portion having a first longitudinal central axis, said manifold portion being formed of a first metal having a first thermal conductivity, adhesive passage means extending along said manifold portion transversely to the work flow path of the veneer sections, a plurality of adhesive dispenser head portions disposed above and connected with said manifold portion, each of said adhesive dispenser head portions including outlet means for dispensing adhesive to be engaged by a leading end portion of one veneer section and pressed against a trailing end portion of a next preceding veneer section, valve means connected in fluid communication with said adhesive passage means and said outlet means in said adhesive dispenser head portions for controlling flow of adhesive between said adhesive passage means and said adhesive dispenser head portions, elongated heater means disposed in and extending along said manifold portion transversely to the work flow path of the veneer sections for heating the adhesive in said adhesive passage means, said heater means having a second longitudinal central axis, a plurality of elongated heat conductor means for transmitting heat from said heater means to said plurality of adhesive dispenser head portions, each of said heat conductor means having a longitudinal central axis which extends transversely to said first and second longitudinal central axes and which extends through said heater means, each of said heat conductor means having a first end portion which is disposed in engagement with said heater means and a second end portion which is disposed in engagement with one of said adhesive dispenser head portions, said longitudinal central axis of each of said heat conductor means extending through said first and second end portions of said heat conductor means, said heat conductor means being formed of a second metal having a second thermal conductivity which is greater than said first thermal conductivity.

24. An apparatus for use in forming core layers for plywood from a plurality of veneer sections, said apparatus comprising a manifold portion extending transversely to a work flow path of the veneer sections and across which the veneer sections are sequentially moved, adhesive passage means extending along said manifold portion transversely to the work flow path of the veneer sections, a plurality of adhesive dispenser head portions disposed above and connected with said manifold portion, each of said adhesive dispenser head portions including outlet means for dispensing adhesive to be engaged by a leading end portion of one veneer section and pressed against a trailing end portion of a next preceding veneer section, valve means connected in fluid communication with said adhesive passage means and said outlet means in said adhesive dispenser head portions for controlling flow of adhesive between said adhesive passage means and said adhesive dispenser head portions, heater means disposed in and extending along said manifold portion transversely to the work flow path of the veneer sections for heating the adhesive in said adhesive passage means, and a plurality of heat conductor means for transmitting heat from said heater means to said plurality of adhesive dispenser head portions, each of said heat conductor means being at least partially disposed in one of said heat conductor passages in said manifold portion and extending from said heater means to one of said adhesive dispenser head portions, each of said heat conductor passages having an inner side surface area which extends around and is spaced from one of said heat conductor means to retard heat transfer between said heat conductor means and said manifold portion, each of said heat conductor means having a thermal conductivity which is greater than the thermal conductivity of said manifold portion to promote a transfer of heat from said heater means to one of said adhesive dispenser head portions through said heat conductor means.

* * * * *